US007245284B2

(12) United States Patent
Iwasaki

(10) Patent No.: US 7,245,284 B2
(45) Date of Patent: Jul. 17, 2007

(54) LIQUID CRYSTAL DISPLAY PANEL DRIVING APPARATUS AND LIQUID CRYSTAL DISPLAY APPARATUS

(75) Inventor: Eiji Iwasaki, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 665 days.

(21) Appl. No.: 10/830,215

(22) Filed: Apr. 22, 2004

(65) Prior Publication Data

US 2004/0212574 A1 Oct. 28, 2004

(30) Foreign Application Priority Data

Apr. 28, 2003 (JP) ..... 2003-124056

(51) Int. Cl.
*H09G 3/36* (2006.01)

(52) U.S. Cl. ..... 345/100; 345/204

(58) Field of Classification Search ..... 345/87–100, 345/204

See application file for complete search history.

(56) References Cited

U.S. PATENT DOCUMENTS 7,106,321 B2 * 9/2006 Morita ..... 345/211

FOREIGN PATENT DOCUMENTS

JP 07219482 A 8/1995

* cited by examiner

*Primary Examiner*—Richard Hjerpe
*Assistant Examiner*—Jean Lesperance
(74) *Attorney, Agent, or Firm*—Pearne & Gordon LLP

(57) ABSTRACT

The present invention provides an LCD panel driving apparatus capable of inexpensively and precisely performing DC-free AC driving of an LCD panel, as well as an LCD apparatus to be driven by such driving apparatus. The LCD panel driving apparatus of the present invention comprises a reference voltage generating unit provided with a serial unit including a plurality of resistors connected in series, a first switch for supplying a first potential in a first mode and a second potential in a second mode to a terminal of the serial unit and a second switch for supplying the second potential in the first mode and the first potential in the second mode to the other terminal of the serial unit for outputting voltages from connection points between the plurality of resistors; and a driving unit for selectively outputting one of the plurality of voltages according to a value of image data for applying the voltage to a terminal of a pixel of an LCD panel.

31 Claims, 8 Drawing Sheets

LIQUID CRYSTAL DISPLAY PANEL DRIVING APPARATUS AND LIQUID CRYSTAL DISPLAY APPARATUS

BACKGROUND OF THE INVENTION

The present invention relates to a liquid crystal display panel driving apparatus, and to a liquid crystal display apparatus to be driven by the same.

In recent years, liquid crystal display (hereinafter referred to as "LCD") panel driving apparatuses for converting input digital image data into analog image data according to a plurality of reference voltages and displaying the image on an LCD panel, as well as LCD apparatuses driven by such driving apparatus, have become popularly available in the market.

An example of a conventional LCD panel driving apparatus and an LCD panel driven by the same will be described referring to FIG. 5 to FIG. 8. FIG. 5 is a block diagram showing a configuration of a conventional digital-input LCD apparatus. In FIG. 5, the numeral 501 indicates a gate driver for generating a vertical timing for writing data and the like, numeral 502 indicates an LCD panel constituted of a thin film transistor and so on, and numeral 503 indicates a source driver for writing horizontal image data into the LCD panel.

The digital-input LCD apparatus constituted as above operates as follows. The source driver 503 is provided with digital image data (6 bits each of RGB in this example) and a plurality of reference voltage values ((n+1) points in this example, where n is an arbitrary positive integer) ranging from a ground potential to a source potential E0. A D/A converter in the source driver converts a digital value representing image data into a corresponding analog voltage value according to a bending line approximating a reference voltage values (Vref(0) to Vref(n) in this example), and outputs the analog voltage value. The gate driver 501 generates a timing signal for writing the data in a thin film transistor and the like of the LCD panel 502, so that the analog image data output by the source driver 503 is written in the LCD panel according to the timing signal.

The LCD panel is usually driven by AC (alternating current), in such a manner that a voltage applied to the LCD panel is inverted at each horizontal scanning period and each vertical scanning period. The Japanese Unexamined Laid Open Gazette Hei 07-219482 proposes direct inversion of digital data itself to be input to an LCD panel, as the simplest method of inverting a voltage to be applied to an LCD panel.

FIG. 6 is a line graph showing voltage values output by the source driver 503 corresponding to both directly inverted and non-inverted digital image data input thereto. In FIG. 6, the horizontal axis indicates the digital data, while the vertical axis indicates the voltage value. According to FIG. 6, in case where the digital image data itself is inverted, a conversion characteristic from inverted digital data to output voltage value is shown by a bending line made by making the bending line representing a conversion characteristic from non-inverted digital data to output voltage value folded back at a median value of the digital data (a bending line laterally folded back at a center of the horizontal axis).

Focusing on the output voltage corresponding to the respective digital values, the conversion characteristic from non-inverted digital data to output voltage value and that from inverted digital data to output voltage value do not constitute vertically symmetrical bending lines with respect to the median point E0/2 of the voltage (The conversion characteristic from inverted digital data to output voltage value deviates from an ideal curve shown in FIG. 6.).

Therefore, a completely DC-free AC driving cannot be performed for the LCD panel.

In case where a DC component is contained in a voltage to be applied to an LCD panel, performance thereof is prone to cause the LCD panel degraded, thereby shortening its life span. Accordingly, a set of a plurality of reference voltages Vref(k) (k=0 to n) approximating the bending lines in the graph has been designed such that a DC component is excluded from a voltage to be applied to an LCD panel, to a substantially equal extent in average over various types of screen images.

On the other hand, a conversion characteristic from digital data to output voltage value, which constitutes a so-called gamma curve, is an important factor in creating a visual impression given to a user through an LCD panel. However, the necessity of excluding a DC component from a voltage to be applied to an LCD panel when constituting a set of reference voltages Vref(k) (k=0 to n) has been restricting the designing freedom of the conversion characteristic from digital data to output voltage value that provides a user with a most preferable visual effect.

Some of the latest digital-input LCD panels are designed such that a plurality of reference voltage values are input to an internal D/A converter, which converts the input data to analog data according to a conversion characteristic approximating a bending line formed based on the reference voltage values, and the reference voltage value is inverted so that the analog data converted by the D/A converter is inverted.

FIG. 7 is a bending line graph showing a conversion characteristic achieved by such LCD panel with respect to inverted and non-inverted reference voltages Vref(k) (k=0 to n). In FIG. 7, the horizontal axis indicates the digital data, while the vertical axis indicates the voltage value. In this case, since the voltage itself of the Vref(n) (n=0 to 10) is inverted, the line forms a vertically symmetrical waveshape, thereby achieving a substantially ideal waveshape of inverted and non-inverted voltages.

FIG. 8 is a circuit diagram of a reference voltage generating unit popularly used for inverting the reference voltage. In FIG. 8, the numerals R100 to R10*n* and R200 to R20*n* represent individual resistors in separate resistors groups, one end of which is connected to a power source and the other end to a ground in opposite polarities between each other. Resistance values are set as R100=R200, R101=R201, and R10*n*=R20*n* respectively. Selectors 0 to n are selector switches for alternately selecting a voltage value divided by resistors R100 to R10*n* and a voltage value divided by resistors R200 to R20*n* for each horizontal scanning period. A conventional reference voltage generating unit is constituted as above. Referring to output terminals Vref(0) to Vref(n), a voltage corresponding to a bent point of a non-inverted voltage line and a voltage corresponding to a bent point of an inverted voltage line shown in FIG. 7 are alternately output from these terminals at each horizontal scanning period.

Though the reference voltage generating unit according to FIG. 8 can symmetrically output the inverted and non-inverted voltage values, such unit requires two resistor systems for obtaining predetermined voltages, and the same number of selector switches as that of the voltages to be provided, which inevitably incurs an increase of the circuit scale.

It is an object of the present invention to provide an LCD panel driving apparatus that can inexpensively drive a digital-input LCD panel by employing a circuit capable of inverting a reference voltage without incurring an increase of the circuit scale, and an LCD apparatus to be driven by such driving apparatus.

SUMMARY OF THE INVENTION

For achieving the foregoing object, the present invention is constituted as follows. According to an aspect of the present invention, there is provided a liquid crystal display panel driving apparatus comprising a reference voltage generating unit provided with a serial unit including a plurality of resistors connected in series, a first switch for supplying a first potential in a first mode and a second potential lower than the first potential in a second mode to a terminal of the serial unit and a second switch for supplying the second potential in the first mode and the first potential in the second mode to the other terminal of the serial unit, for outputting the respective voltages from connection points between the plurality of resistors; and a driving unit for receiving image data and the plurality of voltages output by the reference voltage generating unit and for selectively outputting one of the plurality of voltages and a plurality of voltages generated therefrom by voltage division by using resistors according to a value of the image data, for applying the voltage to a terminal of a pixel of a liquid crystal display panel.

The present invention provides an inexpensive LCD panel driving apparatus having a small-scale circuit, yet capable of accurately inverting a reference voltage value.

The present invention also provides an LCD panel driving apparatus capable of precisely reducing a DC component in a voltage to be applied to an LCD panel to substantially zero.

According to another aspect of the present invention, there is provided a liquid crystal display panel driving apparatus comprising a reference voltage generating unit provided with a serial unit including a plurality of resistors connected in series, a first switch for supplying a first potential in a first mode and a second potential lower than the first potential in a second mode to a terminal of the serial unit and a second switch for supplying the second potential in the first mode and the first potential in the second mode to the other terminal of the serial unit for outputting the respective voltages from connection points between the plurality of resistors; and a driving unit for receiving image data and the plurality of voltages output by the reference voltage generating unit and for selectively outputting one of the plurality of voltages and a plurality of voltages generated therefrom by voltage division by using resistors according to a value of the image data, for applying the voltage to a terminal of a pixel of a liquid crystal display panel, as well as for outputting a median voltage between the first potential and the second potential for applying the voltage to the other terminal of a pixel of the liquid crystal display panel.

The present invention provides an inexpensive LCD panel driving apparatus having a small-scale circuit, yet capable of accurately inverting a reference voltage value.

The present invention also provides an LCD panel driving apparatus capable of precisely reducing a DC component in a voltage to be applied to an LCD panel to substantially zero.

According to another aspect of the present invention, there is provided a liquid crystal display panel driving apparatus comprising a reference voltage generating unit provided with a serial unit including a plurality of resistors connected in series, a first switch for supplying a first potential in a first mode and a second potential lower than the first potential in a second mode to a terminal of the serial unit and a second switch for supplying the second potential in the first mode and the first potential in the second mode to the other terminal of the serial unit for outputting the respective voltages from connection points between the plurality of resistors; and a driving unit for receiving image data and the plurality of voltages output by the reference voltage generating unit and for selectively outputting one of the plurality of voltages and a plurality of voltages generated therefrom by voltage division by using resistors according to a value of the image data, for applying the voltage to a terminal of a pixel of a liquid crystal display panel, as well as for outputting the first potential in the first mode and the second potential in the second mode for applying the voltage to the other terminal of a pixel of the liquid crystal display panel.

The present invention provides an inexpensive LCD panel driving apparatus having a small-scale circuit, yet capable of accurately inverting a reference voltage value.

The present invention also provides an LCD panel driving apparatus capable of precisely reducing a DC component in a voltage to be applied to an LCD panel to substantially zero.

According to still another aspect of the present invention, there is provided the foregoing liquid crystal display panel driving apparatus, wherein at least two resistors among the plurality of resistors have different resistance values.

The present invention provides an LCD panel driving apparatus capable of displaying an image based on a predetermined gamma characteristic, with a DC component in a voltage to be applied to an LCD panel precisely retained at substantially zero.

According to still another aspect of the present invention, there is provided the foregoing liquid crystal display panel driving apparatus, wherein at least two resistors among the plurality of resistors have different resistance values; and voltages obtained by subtracting a median voltage between the first potential and the second potential from a plurality of voltages generated by voltage division by using resistors from the voltages constitute voltage pairs of substantially identical values of opposite polarities.

The present invention provides an LCD panel driving apparatus capable of displaying an image based on a predetermined gamma characteristic, with a DC component in a voltage to be applied to an LCD panel precisely retained at substantially zero.

According to still another aspect of the present invention, there is provided the foregoing liquid crystal display panel driving apparatus, wherein the first switch and the second switch are provided with a PNP bipolar transistor or a P-channel MOS transistor connecting the first potential and the serial unit, and an NPN bipolar transistor or an N-channel MOS transistor connecting the second potential and the serial unit.

The present invention provides an inexpensive LCD panel driving apparatus having a small-scale circuit, yet capable of accurately inverting a reference voltage value.

According to still another aspect of the present invention, there is provided the foregoing liquid crystal display panel driving apparatus, wherein the first mode and the second mode alternate in a pixel at each vertical synchronizing period of image data.

The present invention provides an LCD panel driving apparatus capable of precisely reducing a DC component in a voltage to be applied to an LCD panel to substantially zero utilizing a timing signal for switching vertical scanning period of a screen, without causing a flicker in the screen.

According to still another aspect of the present invention, there is provided the foregoing liquid crystal display panel driving apparatus, wherein the first mode and the second mode alternate at each horizontal synchronizing period of image data.

The present invention provides an LCD panel driving apparatus capable of more precisely reducing a DC component in a voltage to be applied to an LCD panel to substantially zero utilizing a timing signal for switching horizontal scanning period of a screen. Also, the present invention permits eliminating a screen flicker.

According to still another aspect of the present invention, there is provided the foregoing liquid crystal display panel driving apparatus, wherein the first mode and the second mode alternate in each individual pixel of the image data.

The present invention provides an LCD panel driving apparatus capable of more precisely reducing a DC component in a voltage to be applied to an LCD panel to substantially zero, without causing a flicker in the screen.

According to still another aspect of the present invention, there is provided the foregoing liquid crystal display panel driving apparatus, wherein the first potential is a source potential, and the second potential is a ground potential.

The present invention provides an LCD panel driving apparatus that can be constituted of a small-scale circuit through a simplified process, utilizing the source voltage and the ground voltage employed for driving the LCD panel as a high potential and a low potential respectively.

According to still another aspect of the present invention, there is provided the foregoing liquid crystal display panel driving apparatus, wherein the reference voltage generating unit is provided with a plurality of serial unit sets respectively including a plurality of resistors connected in series; the first switch for supplying the first potential in the first mode and the second potential lower than the first potential in the second mode to a terminal of the serial unit selected out of the plurality of serial unit sets according to a command from outside of the reference voltage generating unit; the second switch for supplying the second potential in the first mode and the first potential in the second mode to the other terminal of the selected serial unit; and outputs the respective voltages from connection points of the plurality of resistors of the selected serial unit.

The present invention provides an LCD panel driving apparatus that permits freely selecting a conversion characteristic from digital data to output voltage value, which constitutes a so-called gamma curve, out of a plurality of characteristics, with a DC component in a voltage to be applied to an LCD panel precisely retained at substantially zero.

According to still another aspect of the present invention, there is provided a liquid crystal display apparatus comprising the foregoing liquid crystal display panel driving apparatus; and a liquid crystal display panel.

The present invention provides an inexpensive LCD apparatus having a small-scale circuit, yet capable of accurately inverting a reference voltage value, as a result of employing the LCD panel driving apparatus according to the present invention.

The present invention also provides an LCD apparatus capable of precisely reducing a DC component in a voltage to be applied to an LCD panel to substantially zero.

Novel features of the present invention are specifically recited in the appended claims, however further constitutions and advantages, as well as other objects and features of the present invention will be more apparent from the subsequent detailed description in combination with the accompanying drawings.

It is to be understood that a part or an entirety of these drawings is schematically expressed only for an illustrative purpose, and may not accurately reflect an actual relative size or a position of a component shown therein.

DETAILED DESCRIPTION OF THE INVENTION

The embodiments representing the best mode of carrying out the present invention will now be described hereunder, referring to the accompanying drawings.

<<Embodiment 1>>

Figure 1:
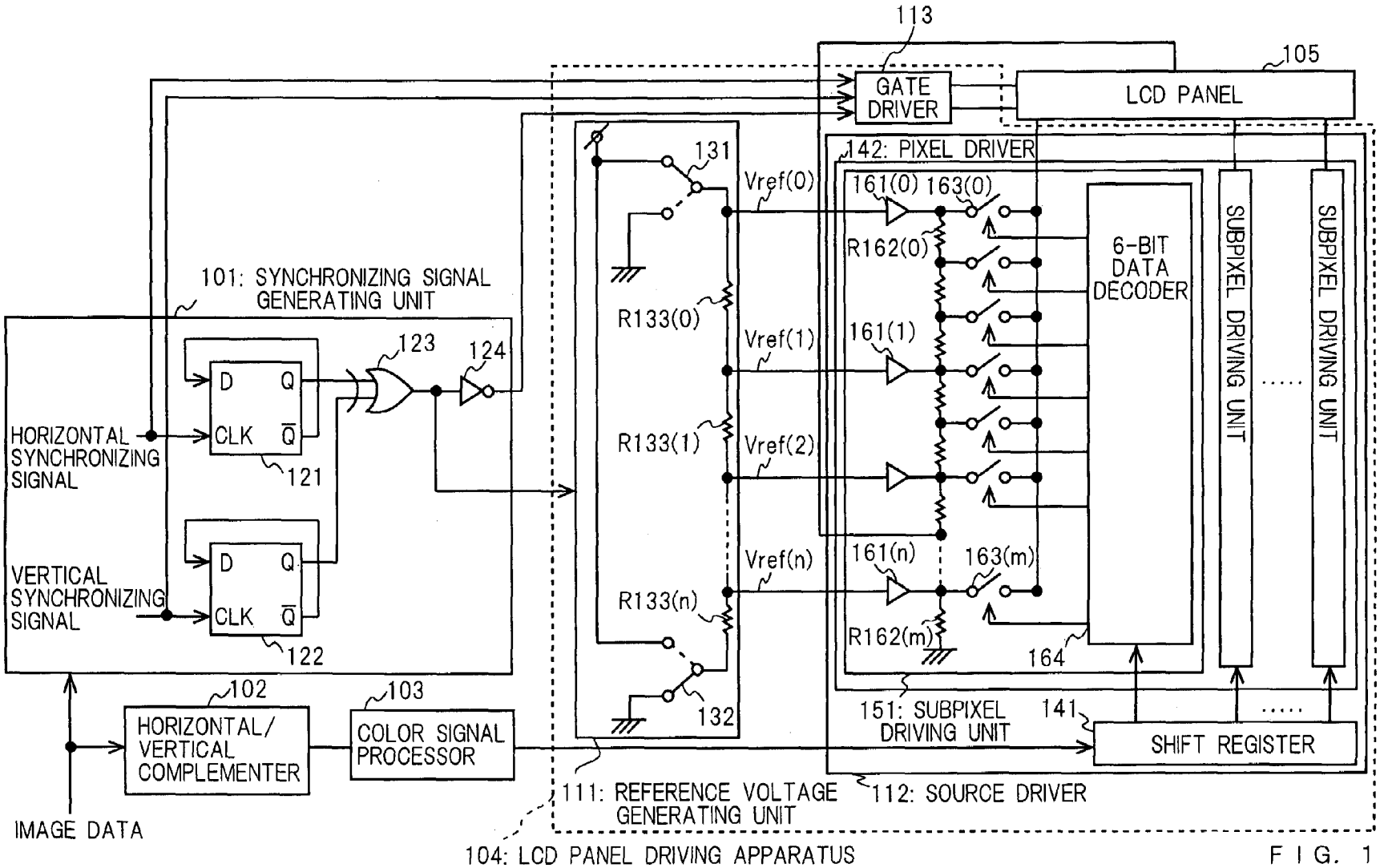
FIG. 1 is a block diagram showing a configuration of a liquid crystal display apparatus according to the first embodiment of the present invention.
Figure 2:
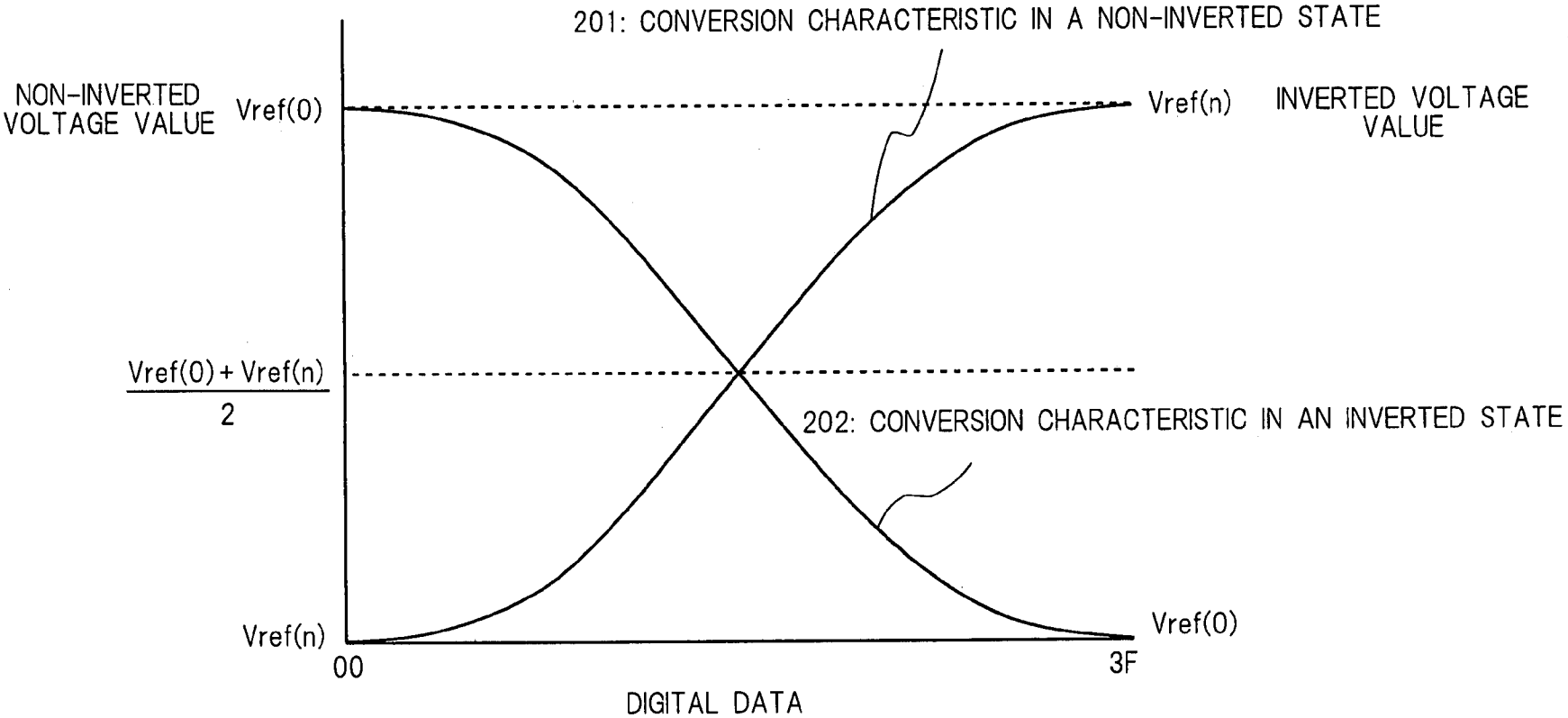
FIG. 2 is a line graph showing voltage values output by a source driver corresponding to an inverted and non-inverted reference voltage, according to the first embodiment of the present invention.

Referring to FIG. 1 and FIG. 2, an LCD panel driving apparatus and an LCD apparatus according to the first embodiment will be described. FIG. 1 is a block diagram showing a configuration of an LCD apparatus according to this embodiment. In this drawing, the numeral 101 indicates a generating unit of a synchronizing signal for driving liquid crystal (hereinafter simply referred to as "synchronizing signal generating unit"); the numeral 102 indicates a horizontal/vertical complementer; the numeral 103 indicates a color signal processor; the numeral 104 indicates an LCD panel driving apparatus; the numeral 105 indicates an LCD panel. The LCD panel driving apparatus 104 is provided with a reference voltage generating unit 111, a source driver 112, and a gate driver 113.

The synchronizing signal generating unit 101 is provided with a D-flipflop circuits 121, 122, an exclusive OR circuit 123, and an inverter 124. The D-flipflop circuit 121 receives a horizontal synchronizing signal, and outputs a High level and a Low level alternately. The D-flipflop circuit 122 receives a vertical synchronizing signal, and outputs a High level and a Low level alternately.

The exclusive OR circuit 123 receives the output signal of the D-flipflop circuit 121 and that of the D-flipflop circuit 122, and outputs a High level when these signals are different, but outputs a Low level when these are the same. The inverter 124 inverts an input signal and outputs the inverted signal.

The signal output by the exsclusive OR circuit 123 is provided to the reference voltage generating unit 111. The horizontal synchronizing signal, the vertical synchronizing signal and the signal output by the inverter 124 are provided to the gate driver 113. The synchronizing signal generating unit 101 outputs a synchronizing signal for driving liquid crystal, which is inverted at each horizontal line, as well as at each vertical synchronizing period with respect to each horizontal line. The LCD panel driving apparatus 104 enters a first mode when the synchronizing signal for driving liquid crystal is at a High level, and enters a second mode when this signal is at a Low level. The first mode and the second mode may alternate only at each vertical synchronizing signal period of image data.

The horizontal/vertical complementer 102 receives the image data, and complements a number of the image data so as to match a number of pixels in horizontal and vertical directions of the LCD panel 105.

The color signal processor 103 controls a contrast of RGB, white balance, etc.

The reference voltage generating unit 111 is provided with a first switch 131, a second switch 132, and resistors R133(0) to R133(*n*) (n is an arbitrary positive integer not less than 2). The first switch 131 switches a voltage to be supplied to a terminal of the resistor group, i.e. on the side of the resistor R133(0) to either a source potential E0 or a ground potential. The second switch 132 switches a voltage to be supplied to the other terminal of the resistor group, i.e. on the side of the resistor R133(*n*), to either a source potential E0 or a ground potential.

In the first mode, the first switch 131 and the second switch 132 are connected as shown by a solid line in FIG. 1. The first switch supplies the source potential E0 to the resistor R133(0), while the second switch 132 supplies the ground potential to the resistor 133(*n*) (when the reference voltage is not inverted). In the second mode, the first switch 131 and the second switch 132 are connected as shown by a broken line in FIG. 1. The first switch 131 supplies the ground potential to the resistor R133(0), while the second switch 132 supplies the source potential E0 to the resistor 133(*n*) (when the reference voltage is inverted).

The resistors R133(0) to R133(*n*) determine the reference voltage Vref(0) to Vref(n). The voltages Vref(0) to Vref(n) divided by the resistors R133(0) to R133(*n*) are supplied to a pixel driver 142 in the source driver 112.

The source driver 112 is provided with a shift register 141 and the pixel driver 142. The shift register 141 receives serial digital data of RGB, each composed of 6 bits, output by the color signal processor 103, and converts the data to a parallel signal and outputs the same.

The pixel driver 142 is provided with subpixel driving units 151, a number of which is three times (RGB) of a number of horizontal pixels of the LCD panel 105. The subpixel driving unit 151 includes input terminals 161(0) to 161(*n*), resistors R162(0) to R162(*m*)(m>n, and both are arbitrary positive integers,), switches 163(0) to 163(*m*), and a 6-*bit* data decoder 164. The input terminals 161(0) to 161(*n*) respectively receive a voltage Vref(0) to Vref(n) output by the reference voltage generating unit 111.

The 6-bit data decoder 164 receives a digital signal output by the shift register 141, and turns on one of the switches 163(0) to (*m*) according to a value of the digital signal, turning off all other switches. Then a voltage divided by the resistor R162(0) to R162(*m*) passes through the switch that is turned on, and is applied to a terminal of a pixel of the LCD panel 105. At this stage, the voltage has a value shown in FIG. 2.

Resistors located the same number of resistors away in opposite directions from the median point of the serial unit of the resistors R133(0) to R133(*n*) have an equivalent resistance value, and a resistor located farther from the median point has a smaller resistance value. Accordingly, a voltage obtained by subtracting a half of the source potential E0/2 from a voltage Vref(0) to Vref(*n*) divided by the resistors R133(0) to R133(*n*) constitutes a voltage pair of a substantially identical value of opposite polarities.

FIG. 2 is a line graph showing a voltage value output by the subpixel driving unit 151 in the source driver 112, in the first mode (when the reference voltage is not inverted) and the second mode (when the reference voltage is inverted). In FIG. 2, the horizontal axis indicates the digital data, while the vertical axis indicates the voltage value. The numeral 201 indicates a curve representing a conversion characteristic in the first mode (when the reference voltage is not inverted), and 202 a curve representing a conversion characteristic in the second mode (when the reference voltage is inverted). The conversion characteristic from the non-inverted digital data to the output voltage value and the conversion characteristic from the inverted digital data to the output voltage value form vertically symmetrical curves with respect to the median point E0/2 of the voltage (A substantially ideal curve can be achieved.). Therefore, completely DC-free AC driving of the LCD panel can be executed.

The subpixel driving unit 151 receives the image data in a digital value, and outputs a corresponding analog voltage value according to the curve 201 (the first mode) or the curve 202 (the second mode) approximating a voltage value divided by the resistors R133(0) to R133(*n*)(n is an arbitrary positive integer) and the resistors R162(0) to R162(*m*) (m is an arbitrary positive integer).

To the other terminal of a pixel of the LCD panel 105, the median voltage (E0/2) between the source potential E0 and the ground potential 0V is applied.

The gate driver 113 receives the horizontal synchronizing signal, the vertical synchronizing signal and the signal output by the inverter 124 in the synchronizing signal generating unit 101, and outputs a timing signal for writing data.

The LCD panel 105 displays the analog image data output by the source driver 112, in synchronization with the timing signal output by the gate driver 113.

The LCD panel driving apparatus and the LCD apparatus constituted as above according to the first embodiment of the present invention can be operated as described hereunder.

The reference voltage generating unit 111 connects the first switch 131 and the second switch 132 as shown by the solid line in FIG. 1 in the first mode, for supplying the source potential E0 to the resistor R133(0) and the ground potential to the resistor R133(*n*). Under such state, the reference voltage generating unit 111 outputs the voltage values Vref (0) to Vref(n) corresponding to the curve 201 representing the non-inverted voltages in FIG. 2.

By contrast, in the second mode the reference voltage generating unit 111 connects the first switch 131 and the second switch 132 as shown by the broken line in FIG. 1, for supplying the ground potential to the resistor R133(0) and the source potential E0 to the resistor R133(*n*). Under such state, the reference voltage generating unit 111 outputs the voltage values Vref(0) to Vref(n) corresponding to the curve 202 representing the inverted voltages in FIG. 2.

As a result, a non-inverted and an inverted reference voltage value are alternately supplied as Vref(0) to Vref(n), each time the first switch 131 and the second switch 132 are switched. The LCD panel driving apparatus and the LCD apparatus according to the first embodiment of the present invention permit obtaining non-inverted and inverted reference voltages as shown in FIG. 2 with a small-scale circuit, thereby enabling inexpensive AC driving of the LCD panel.

By the way, in the first embodiment the resistance values are symmetrically allocated with respect to the median point of the serial unit of the resistors R133(0) to R133(*n*) from the viewpoint of the consistency with FIG. 2, however the present invention is not limited to such allocation of the resistance values.

<<Embodiment 2>>

Figure 3:
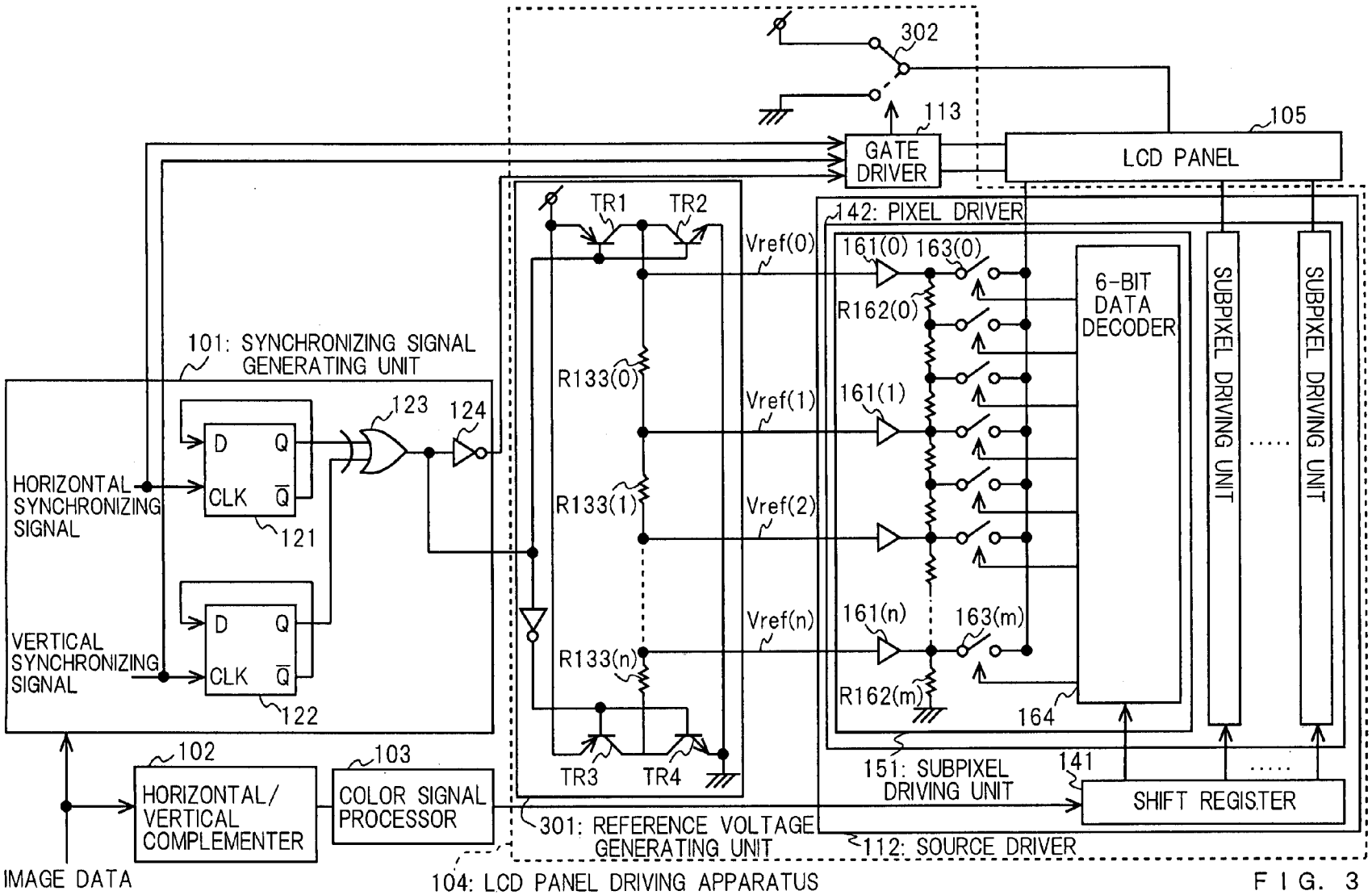
FIG. 3 is a block diagram showing a configuration of a liquid crystal display apparatus according to the second embodiment of the present invention.
Figure 7:
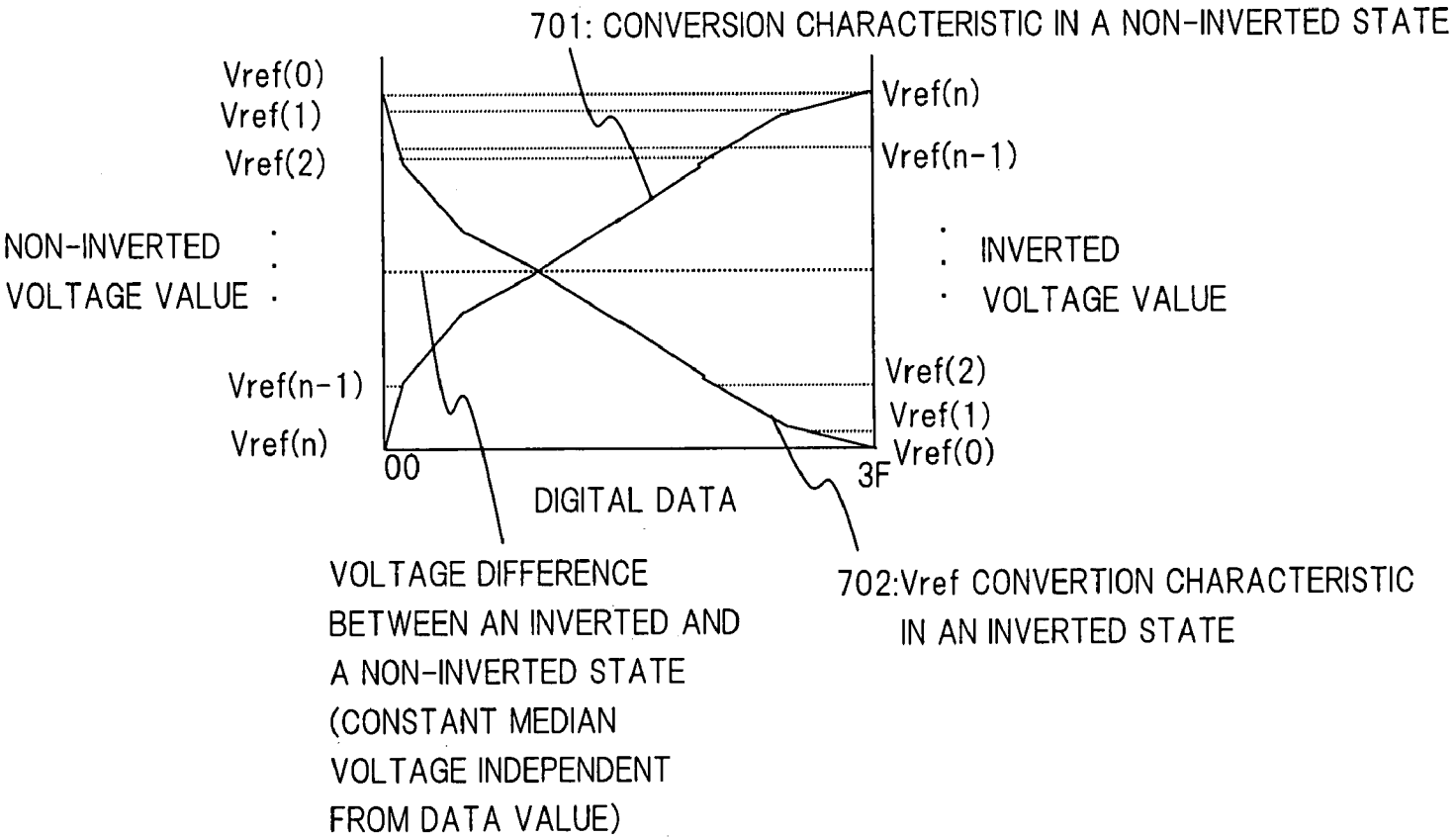
FIG. 7 is a line graph showing voltage values output by a source driver corresponding to an inverted and non-inverted reference voltage, according to the second embodiment of the present invention and to a conventional apparatus.
Figure 8:
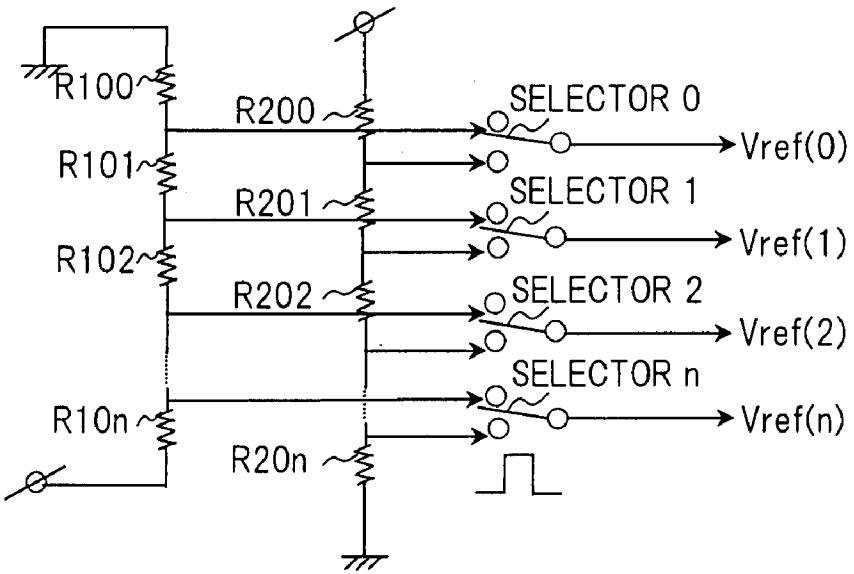
FIG. 8 is a circuit diagram of a conventional reference voltage generating unit.

Referring to FIG. 3 and FIG. 7, an LCD panel driving apparatus and an LCD apparatus according to the second embodiment will be described. FIG. 3 is a block diagram showing a configuration of an LCD apparatus according to this embodiment. A difference between the LCD panel driving apparatus and the LCD apparatus of the first and the second embodiments lies in the reference voltage generating unit 301 and the switch 302. Since the remaining components are identical to those of the first embodiment, the same numerals are given thereto and detailed description thereof will be omitted.

The reference voltage generating unit 301 will now be described. The reference voltage generating unit 301 of the second embodiment is different from the reference voltage generating unit 111 of the first embodiment in that a resistor located farther from R133 (0) toward R133(*n*) has a smaller resistance value in the serial unit of the resistors R133(0) to R133(*n*). In FIG. 3, the first switch 131 and the second switch 132 are respectively represented by PNP bipolar transistors TR1, TR3 and NPN bipolar transistors TR2, TR4 which physically constitute the switches.

The PNP bipolar transistor TR1 and the NPN bipolar transistor TR2 switch a voltage to be supplied to a terminal of the resistor group on the side of the resistor R133(0) to the source potential E0 in the first mode, and to the ground potential in the second mode. The PNP bipolar transistor TR3 and the NPN bipolar transistor TR4 switch a voltage to be supplied to the other terminal of the resistor group, i.e. on the side of the resistor R133(*n*), to the ground potential in the first mode, and to the source potential E0 in the second mode. TR1 and TR4 are controlled by a single control signal and TR2 and TR3 are also controlled by the same control signal, such that the respective pairs are turned on and off in opposite phases.

In the LCD panel driving apparatus and the LCD apparatus according to the second embodiment, a voltage to be applied to the other terminal of a pixel of the LCD panel 105 is different from that of the first embodiment. According to the first embodiment, the median point voltage E0/2 between the first potential and the second potential is applied to the other terminal of the LCD panel 105. In the LCD panel driving apparatus of the second embodiment, however, the gate driver 113 controls the switch 302 such that the source potential E0 is applied in the first mode and the ground potential is applied in the second mode, to the other terminal of a pixel of the LCD panel 105.

In the second embodiment, the first mode and the second mode alternate at each horizontal line of the image data, as well as at each vertical synchronizing period with respect to each horizontal line. The first mode and the second mode may alternate only at each vertical synchronizing signal period of the image data.

Operation of the LCD panel driving apparatus and the LCD apparatus constituted as above according to the second embodiment of the present invention will be described hereunder, referring to FIG. 7. FIG. 7 is a line graph showing a voltage value output by the subpixel driving unit 151 in the source driver 112, in the first mode (when the reference voltage is not inverted) and the second mode (when the reference voltage is inverted) in the second embodiment. In FIG. 7, the horizontal axis indicates the digital data, while the vertical axis indicates the voltage value. FIG. 7 is identical to a conventional example. The conversion characteristic from the non-inverted digital data to the output voltage value and the conversion characteristic from the inverted digital data to the output voltage value form vertically symmetrical lines with respect to the median point E0/2 of the voltage (A substantially ideal curve can be achieved.). Therefore, completely DC-free AC driving of the LCD panel can be executed.

In the first mode, the reference voltage generating unit 301 turns on the TR1 and TR4, and turns off the TR2 and TR3. Under such state, the terminal on the side of the resistor R133(0) is connected to the source potential, while the terminal on the side of the resistor R133(*n*) is connected to the ground potential, and resultantly the reference voltage generating unit 301 outputs the voltage values Vref(0) to Vref(n) corresponding to bent points of the line 701 representing the non-inverted voltages in FIG. 7.

By contrast, in the second mode the reference voltage generating unit 301 turns on the TR2 and TR3, and turns off the TR1 and TR4. Under such state, the terminal on the side of the resistor R133(0) is connected to the ground potential, while the terminal on the side of the resistor R133(*n*) is connected to the source potential, and resultantly the reference voltage generating unit 301 outputs the voltage values Vref(0) to Vref(n) corresponding to bent points of the line 702 representing the inverted voltages in FIG. 7.

The first mode and the second mode alternate at each vertical synchronizing signal period and at each horizontal synchronizing period of the image data. As a result, a non-inverted and an inverted reference voltage value are alternately supplied as Vref(0) to Vref(n), each time the TR1 and TR4, and the TR2 and TR3 are switched on and off. The LCD panel driving apparatus and the LCD apparatus according to the second embodiment of the present invention permit obtaining non-inverted and inverted reference voltages as shown in FIG. 7 with a small-scale circuit, thereby enabling inexpensive AC driving of the LCD panel.

Meanwhile, the reference voltage generating unit 301 of the second embodiment can also provide a similar benefit in case where the PNP bipolar transistors and the NPN bipolar transistors are substituted with P-channel MOS transistors and N-channel MOS transistors respectively.

By the way, in the second embodiment the serial unit of the resistors R133(0) to R133(*n*) is constituted such that a resistor located farther from R133 (0) toward R133(*n*) has a smaller resistance value from the viewpoint of the consistency with FIG. 7, however the present invention is not limited to such allocation of the resistance values.

<<Embodiment 3>>

Figure 4:
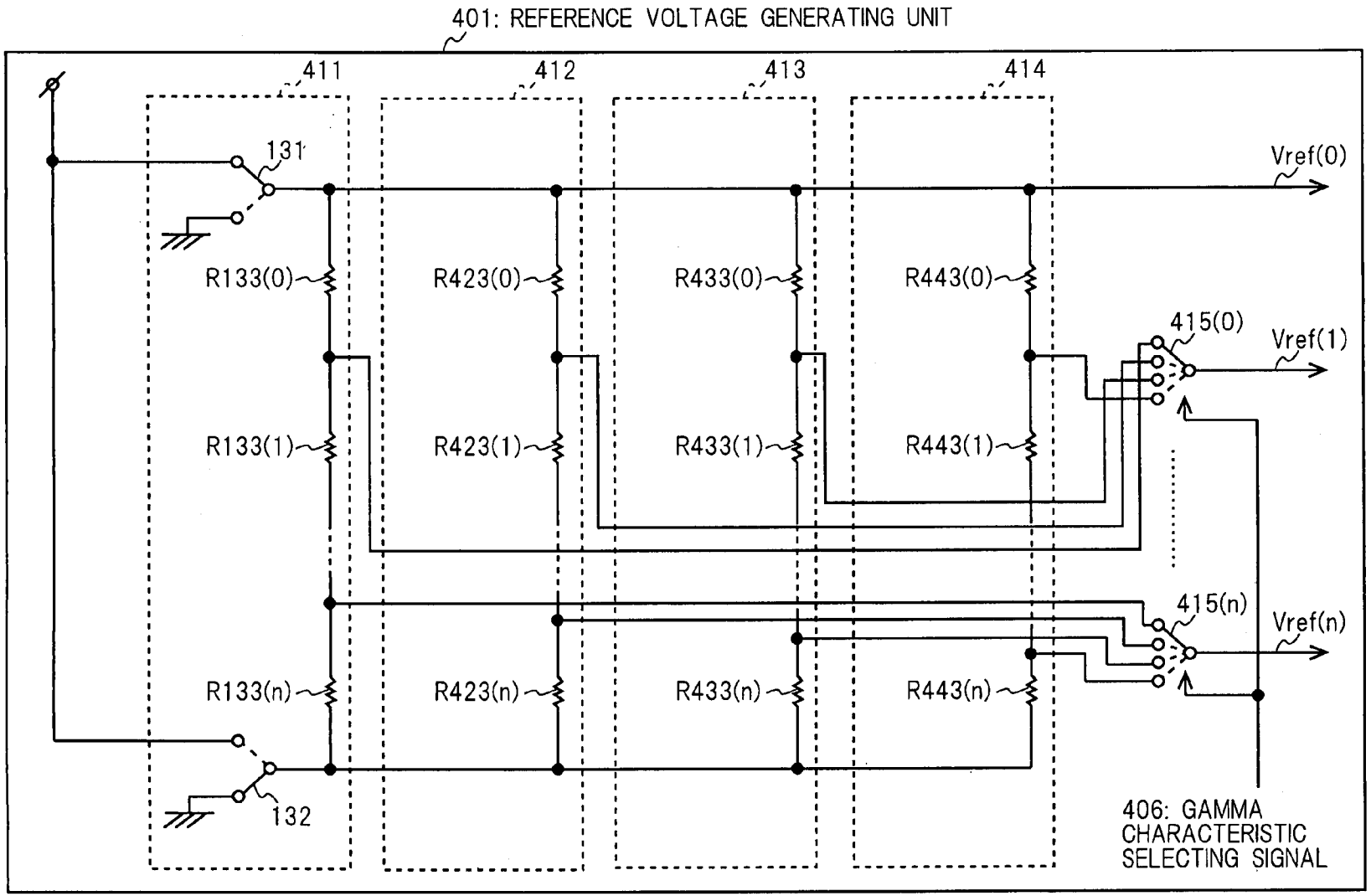
FIG. 4 is a circuit diagram showing a configuration of a reference voltage generating unit of a liquid crystal display apparatus according to the third embodiment of the present invention.
Figure 5:
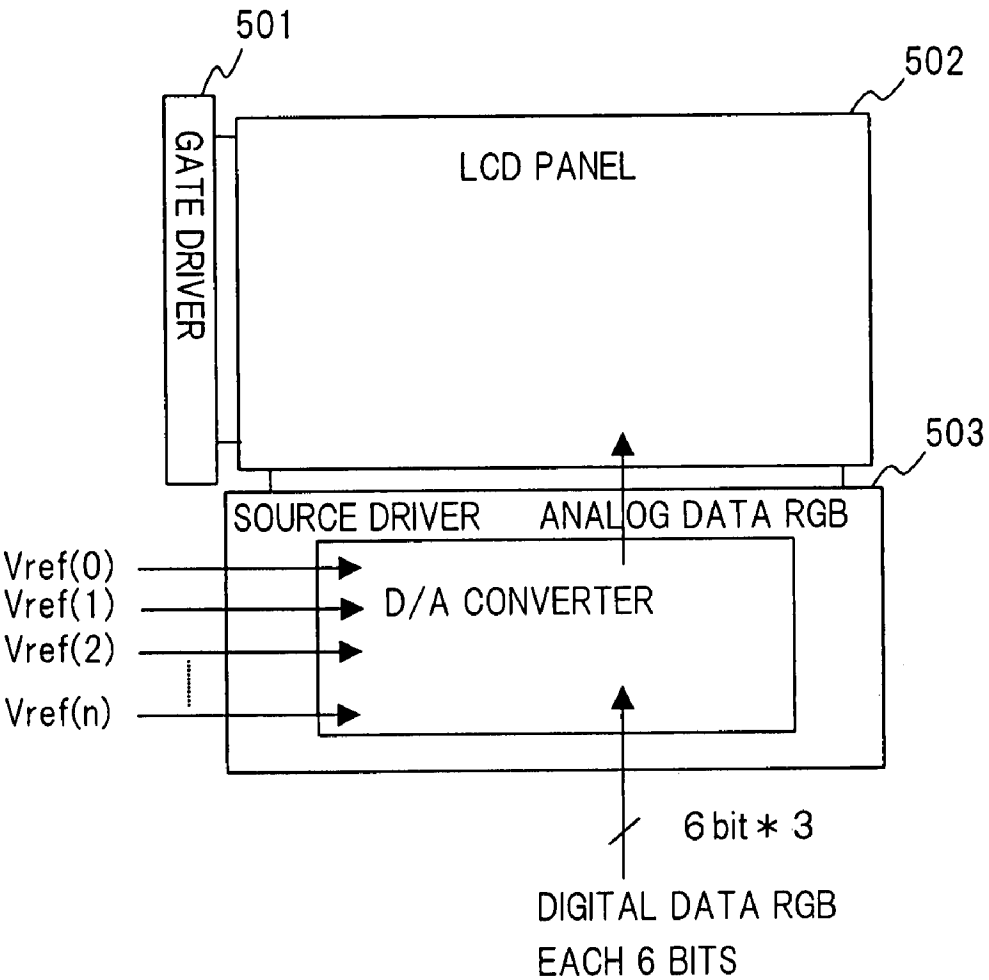
FIG. 5 is a block diagram showing a configuration of a conventional digital-input liquid crystal display apparatus.
Figure 6:
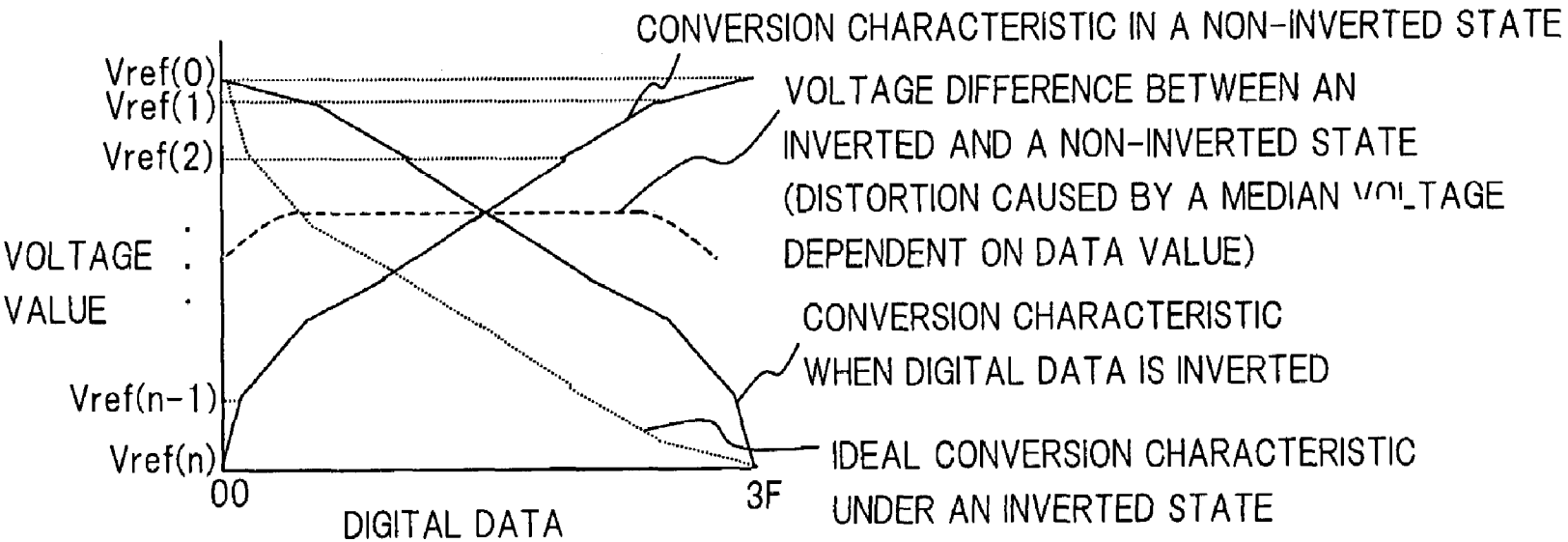
FIG. 6 is a line graph showing voltage values output by a source driver corresponding to inverted and non-inverted digital image data.

Referring to FIG. 4, an LCD panel driving apparatus and an LCD apparatus according to the third embodiment will be described. A difference between the LCD panel driving apparatus and the LCD apparatus of the first and the third embodiments lies in the reference voltage generating unit 401 shown in FIG. 4. Since the remaining components are identical to those of the first embodiment, the same numerals are given thereto and detailed description thereof will be omitted.

The reference voltage generating unit 401 will now be described. FIG. 4 is a circuit diagram showing a configuration of the reference voltage generating unit 401 of the liquid crystal display apparatus according to the third embodiment. The reference voltage generating unit 401 is provided with a first reference voltage generating unit 411, a second reference voltage generating unit 412, a third reference voltage generating unit 413, a fourth reference voltage generating unit 414, and n pieces of 4-way switches 415(0) to 415(*n*). The first reference voltage generating unit 411 is provided with a resistor serial unit including resistors R133(0) to R133(*n*) and switches 131 and 132.

The first reference voltage generating unit 411 is of the identical configuration to the reference voltage generating unit 111 of the first embodiment, therefore detailed description thereof is omitted. The second reference voltage generating unit 412 is provided with a resistor serial unit including resistors R423(0) to R423(*n*). The third reference voltage generating unit 413 is provided with a resistor serial unit including resistors R433(0) to R433(*n*). The fourth reference voltage generating unit 414 is provided with a resistor serial unit including resistors R443(0) to R443(*n*). Terminals of the first to fourth reference voltage generating units 411 to 414 are respectively connected to a switching output terminal of the switches 131 and 132. The respective resistor serial units of the first to fourth reference voltage generating units 411 to 414 have a gamma characteristic different from one another.

A user can select a desired gamma characteristic out of the four characteristics through an operation panel (not shown) of the LCD apparatus. The operation panel outputs a 2-bit gamma characteristic selecting signal 406. The n pieces of 4-way switches 415(0) to (n) receive reference voltages respectively output by the first to fourth reference voltage generating unit 411 to 414, and output the reference voltages Vref(0) to Vref(n) output by one of the first to fourth reference voltage generating units 411 to 414 selected according to the gamma characteristic selecting signal 406.

The LCD apparatus according to the third embodiment is capable of displaying an image of a gamma characteristic arbitrarily selected by a user.

The reference voltage generating unit 401 of the third embodiment may be applied to the LCD panel driving apparatus and the LCD apparatus of the second embodiment, in case of incorporating a plurality (for example four sets) of resistor serial units similarly constituted to that of the reference voltage generating unit 301 of the second embodiment and respectively having a different gamma characteristic.

Meanwhile, in the first to third embodiments, the first mode and the second mode may alternate at each vertical synchronizing signal period of the image data, as well as at each individual pixel. The first mode and the second mode may alternate at each horizontal synchronizing signal period of the image data, as well as at each individual pixel. The first mode and the second mode may alternate at each vertical synchronizing signal period and each horizontal synchronizing signal period of the image data, as well as at each individual pixel.

The present invention can be beneficially applied to an LCD panel driving apparatus and an LCD apparatus.

The present invention provides an LCD panel driving apparatus capable of precisely generating non-inverted and inverted reference voltages free from a DC component through a small-scale circuit, and thereby inexpensively and precisely performing DC-free AC driving of an LCD panel, as well as an LCD apparatus that can be driven by such driving apparatus.

The present invention has been described in reasonable details according to the preferred embodiments, whereas it is to be understood that these embodiments are only exemplary, and that various modifications can be made to constituents or process or a combination thereof, without departing from the scope and spirit of the claimed invention.

The invention claimed is:

1. A liquid crystal display panel driving apparatus comprising:

a reference voltage generating unit provided with a serial unit including a plurality of resistors connected in series, a first switch for supplying a first potential in a first mode and a second potential lower than the first potential in a second mode to a terminal of said serial unit and a second switch for supplying the second potential in the first mode and the first potential in the second mode to the other terminal of said serial unit, for outputting the respective voltages from connection points between said plurality of resistors; and a driving unit for receiving image data and said plurality of voltages output by said reference voltage generating unit and for selectively outputting one of said plurality of voltages and a plurality of voltages generated therefrom by voltage division by using resistors according to a value of said image data, for applying the voltage to a terminal of a pixel of a liquid crystal display panel.

2. The liquid crystal display panel driving apparatus as set forth in claim 1, wherein at least two resistors among said plurality of resistors have different resistance values.

3. The liquid crystal display panel driving apparatus as set forth in claim 1, wherein the first switch and the second switch are provided with a PNP bipolar transistor or a P-channel MOS transistor connecting the first potential and said serial unit, and an NPN bipolar transistor or an N-channel MOS transistor connecting the second potential and said serial unit.

4. The liquid crystal display panel driving apparatus as set forth in claim 1, wherein the first mode and the second mode alternate in a pixel at each vertical synchronizing period of image data.

5. The liquid crystal display panel driving apparatus as set forth in claim 4, wherein the first mode and the second mode alternate at each horizontal synchronizing period of image data.

6. The liquid crystal display panel driving apparatus as set forth in claim 5, wherein the first mode and the second mode alternate in each individual pixel of said image data.

7. The liquid crystal display panel driving apparatus as set forth in claim 4, wherein the first mode and the second mode alternate in each individual pixel of said image data.

8. The liquid crystal display panel driving apparatus as set forth in claim 1, wherein the first potential is a source potential, and the second potential is a ground potential.

9. The liquid crystal display panel driving apparatus as set forth in claim 1, wherein said reference voltage generating unit is provided with a plurality of serial units respectively including a plurality of resistors connected in series;

the first switch for supplying the first potential in the first mode and the second potential lower than the first potential in the second mode to a terminal of said serial unit selected out of said plurality of serial units according to a command from outside of the reference voltage generating unit; and the second switch for supplying the second potential in the first mode and the first potential in the second mode to the other terminal of said selected serial unit; and outputs the respective voltages from connection points of said plurality of resistors of said selected serial unit.

10. A liquid crystal display apparatus comprising:

said liquid crystal display panel driving apparatus according to claim 1; and a liquid crystal display panel.

11. A liquid crystal display panel driving apparatus comprising:

a reference voltage generating unit provided with a serial unit including a plurality of resistors connected in series, a first switch for supplying a first potential in a first mode and a second potential lower than the first potential in a second mode to a terminal of said serial unit and a second switch for supplying the second potential in the first mode and the first potential in the second mode to the other terminal of said serial unit for outputting the respective voltages from connection points between said plurality of resistors; and a driving unit for receiving image data and said plurality of voltages output by said reference voltage generating unit and for selectively outputting one of said plurality of voltages and a plurality of voltages generated therefrom by voltage division by using resistors according to a value of said image data, for applying the voltage to a terminal of a pixel of a liquid crystal display panel, as well as for outputting a median voltage between the first potential and the second potential for applying the voltage to the other terminal of a pixel of said liquid crystal display panel.

12. The liquid crystal display panel driving apparatus as set forth in claim 11, wherein at least two resistors among said plurality of resistors have different resistance values.

13. The liquid crystal display panel driving apparatus as set forth in claim 11, wherein at least two resistors among said plurality of resistors have different resistance values; and voltages obtained by subtracting a median voltage between the first potential and the second potential from a plurality of voltages generated by voltage division by using resistors from the voltages constitute voltage pairs of substantially identical values of opposite polarities.

14. The liquid crystal display panel driving apparatus as set forth in claim 11, wherein the first switch and the second switch are provided with a PNP bipolar transistor or a P-channel MOS transistor connecting the first potential and said serial unit, and an NPN bipolar transistor or an N-channel MOS transistor connecting the second potential and said serial unit.

15. The liquid crystal display panel driving apparatus as set forth in claim 11, wherein the first mode and the second mode alternate in a pixel at each vertical synchronizing period of image data.

16. The liquid crystal display panel driving apparatus as set forth in claim 15, wherein the first mode and the second mode alternate at each horizontal synchronizing period of image data.

17. The liquid crystal display panel driving apparatus as set forth in claim 15, wherein the first mode and the second mode alternate in each individual pixel of said image data.

18. The liquid crystal display panel driving apparatus as set forth in claim 15, wherein the first mode and the second mode alternate in each individual pixel of said image data.

19. The liquid crystal display panel driving apparatus as set forth in claim 11, wherein the first potential is a source potential, and the second potential is a ground potential.

20. The liquid crystal display panel driving apparatus as set forth in claim 11, wherein said reference voltage generating unit is provided with a plurality of serial units respectively including a plurality of resistors connected in series;

the first switch for supplying the first potential in the first mode and the second potential lower than the first potential in the second mode to a terminal of said serial unit selected out of said plurality of serial units according to a command from outside of the reference voltage generating unit; and the second switch for supplying the second potential in the first mode and the first potential in the second mode to the other terminal of said selected serial unit; and outputs the respective voltages from connection points of said plurality of resistors of said selected serial unit.

21. A liquid crystal display apparatus comprising:

said liquid crystal display panel driving apparatus according to claim 2; and a liquid crystal display panel.

22. A liquid crystal display panel driving apparatus comprising:

a reference voltage generating unit provided with a serial unit including a plurality of resistors connected in series, a first switch for supplying a first potential in a first mode and a second potential lower than the first potential in a second mode to a terminal of said serial unit and a second switch for supplying the second potential in the first mode and the first potential in the second mode to the other terminal of said serial unit for outputting the respective voltages from connection points between said plurality of resistors; and a driving unit for receiving image data and said plurality of voltages output by said reference voltage generating unit and for selectively outputting one of said plurality of voltages and a plurality of voltages generated therefrom by voltage division by using resistors according to a value of said image data, for applying the voltage to a terminal of a pixel of a liquid crystal display panel, as well as for outputting the first potential in the first mode and the second potential in the second mode for applying the voltage to the other terminal of a pixel of said liquid crystal display panel.

23. The liquid crystal display panel driving apparatus as set forth in claim 22, wherein at least two resistors among said plurality of resistors have different resistance values.

24. The liquid crystal display panel driving apparatus as set forth in claim 22, wherein the first switch and the second switch are provided with a PNP bipolar transistor or a P-channel MOS transistor connecting the first potential and said serial unit, and an NPN bipolar transistor or an N-channel MOS transistor connecting the second potential and said serial unit.

25. The liquid crystal display panel driving apparatus as set forth in claim 22, wherein the first mode and the second mode alternate in a pixel at each vertical synchronizing period of image data.

26. The liquid crystal display panel driving apparatus as set forth in claim 25, wherein the first mode and the second mode alternate at each horizontal synchronizing period of image data.

27. The liquid crystal display panel driving apparatus as set forth in claim 26, wherein the first mode and the second mode alternate in each individual pixel of said image data.

28. The liquid crystal display panel driving apparatus as set forth in claim 25, wherein the first mode and the second mode alternate in each individual pixel of said image data.

29. The liquid crystal display panel driving apparatus as set forth in claim 22, wherein the first potential is a source potential, and the second potential is a ground potential.

30. The liquid crystal display panel driving apparatus as set forth in claim 22, said reference voltage generating unit is provided with a plurality of serial units respectively including a plurality of resistors connected in series;

the first switch for supplying the first potential in the first mode and the second potential lower than the first potential in the second mode to a terminal of said serial unit selected out of said plurality of serial units according to a command from outside of the reference voltage generating unit; and the second switch for supplying the second potential in the first mode and the first potential in the second mode to the other terminal of said selected serial unit; and outputs the respective voltages from connection points of said plurality of resistors of said selected serial unit.

31. A liquid crystal display apparatus comprising:

said liquid crystal display panel driving apparatus according to claim 22; and a liquid crystal display panel.

* * * * *